US009835102B2

(12) United States Patent
Kim

(10) Patent No.: US 9,835,102 B2
(45) Date of Patent: Dec. 5, 2017

(54) METHOD FOR CONTROLLING VEHICLE FUEL PUMP

(71) Applicants: Hyundai Motor Company, Seoul (KR); KIA MOTORS CORP., Seoul (KR)

(72) Inventor: Hyun Kim, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 82 days.

(21) Appl. No.: 14/933,746

(22) Filed: Nov. 5, 2015

(65) Prior Publication Data

US 2016/0138513 A1 May 19, 2016

(30) Foreign Application Priority Data

Nov. 14, 2014 (KR) ..... 10-2014-0158885

(51) Int. Cl.

| | |
|---|---|
| ***F02M 1/00*** | (2006.01) |
| ***F02D 41/06*** | (2006.01) |
| ***F02D 41/30*** | (2006.01) |
| ***F02D 41/00*** | (2006.01) |

(52) U.S. Cl.

CPC ..... *F02D 41/062* (2013.01); *F02D 41/0027* (2013.01); *F02D 41/3082* (2013.01)

(58) Field of Classification Search

CPC ..... F02D 2001/0085; F02D 2200/0618; F02D 2700/10; F02D 41/30; F02D 41/3809; F02M 37/0029

USPC ..... 701/101–105, 113; 123/445, 446, 456, 123/457

See application file for complete search history.

(56) References Cited

U.S. PATENT DOCUMENTS

2011/0168133 A1* 7/2011 Pursifull ..... F02M 37/0064 123/495
2013/0340717 A1* 12/2013 Avery ..... F02D 41/30 123/478
2015/0159578 A1* 6/2015 Surnilla ..... F02D 41/3076 701/104
2015/0354491 A1* 12/2015 Ulrey ..... F02D 41/123 123/294
2016/0153385 A1* 6/2016 Pursifull ..... F02D 41/3845 123/299
2016/0160789 A1* 6/2016 Kim ..... F02D 41/3005 123/445

(Continued)

FOREIGN PATENT DOCUMENTS

JP H06-173806 A 6/1994
KR 10-2002-0072552 A 9/2002

(Continued)

OTHER PUBLICATIONS

Korean Office Action dated Dec. 7, 2015, issued in corresponding Korean patent application No. 10-2014-0158885.

*Primary Examiner* — John Kwon
(74) *Attorney, Agent, or Firm* — McDermott Will & Emery LLP

(57) ABSTRACT

A method for controlling fuel pump of vehicle includes sensing a vehicle door lock release signal, detecting a fuel pressure in a fuel line, and actuating the fuel pump so that the fuel pressure arrives at a predetermined target pressure when the detected fuel pressure is below a predetermined actuation pressure.

5 Claims, 1 Drawing Sheet

(56) References Cited

U.S. PATENT DOCUMENTS

2016/0252057 A1* 9/2016 Batenburg ..... F04B 23/04

FOREIGN PATENT DOCUMENTS

| | | | |
|---|---|---|---|
| KR | 10-2004-0002084 | A | 1/2004 |
| KR | 10-2005-0092810 | A | 9/2005 |
| KR | 10-2009-0038330 | A | 4/2009 |
| KR | 10-2009-0061827 | A | 6/2009 |
| KR | 10-2010-0019892 | A | 2/2010 |

* cited by examiner

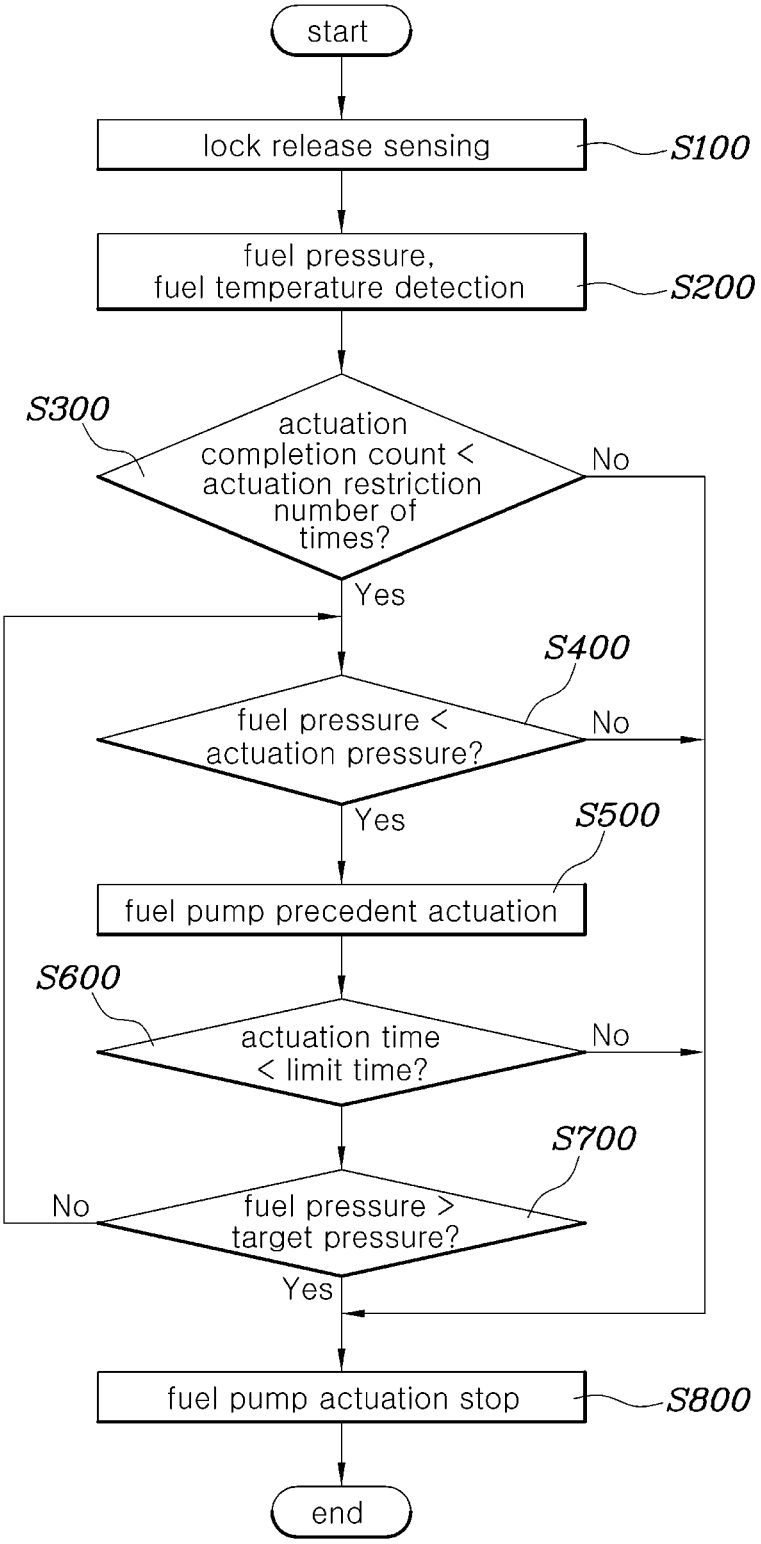
start
lock release sensing
S100
fuel pressure,
fuel temperature detection
S200
S300
actuation
completion count <
actuation restriction
number of
times?
No
Yes
S400
fuel pressure <
actuation pressure?
No
Yes
S500
fuel pump precedent actuation
S600
actuation time
< limit time?
No
S700
No
fuel pressure >
target pressure?
Yes
fuel pump actuation stop
S800
end

METHOD FOR CONTROLLING VEHICLE FUEL PUMP

CROSS-REFERENCE TO RELATED APPLICATION

The present application claims the benefit of priority to Korean Patent Application No. 10-2014-0158885, filed Nov. 14, 2014 with the Korean Intellectual Property Office, the entirety of which is incorporated herein by reference.

TECHNICAL FIELD

The present disclosure relates to a method for controlling a fuel pump of a vehicle. More particularly, the present disclosure relates to a method for controlling a fuel pump of a vehicle which prevents unnecessarily repetitive actuation of the fuel pump to improve endurance and prevent noise.

BACKGROUND

In LPI engines, to liquefy the fuel in the fuel line at the time of starting, the driver directly IG-ONs for a predetermined time, actuates the fuel pump, liquefies the fuel in the fuel line, and actuates a START button to control the start. The time required for liquefying the fuel is approximately 6.4 seconds. LPI vehicles require this pump actuation time to liquefy the fuel before fuel injection because of fuel characteristics (LPG gas), and the waiting time for starting to occur can cause inconvenience to a user. Such a start time can be reduced by actuating the fuel pump by using a door lock release signal before IG-ON condition. The door lock release signal of the driver's remote control can be input to a battery control module (BCM), the battery control module may transmit the input signal to an LPI engine controller through a can communication or a wire line, then the LPI controller recognizes the relevant signal, enters an actuation ready state, and actuates and controls the fuel pump according to the condition of engine.

However, in such conventional technology, since the actuation of the fuel pump is controlled based on the fuel temperature, the fuel pump may come into the actuation condition even in a condition of not requiring the actuation so that part endurance and noise may be adversely affected. Additionally, when a lock/unlock state frequently occurs, this may cause an adverse effect on the noise of the fuel pump and the endurance of the part.

The above information disclosed in this Background section is only for enhancement of understanding of the background of the disclosure and therefore it may contain information that does not form the prior art that is already known in this country to a person of ordinary skill in the art.

SUMMARY OF THE DISCLOSURE

The present disclosure has been made in an effort to solve the above-described problems associated with prior art. An object of the present disclosure is to provide a method for controlling a fuel pump of a vehicle which controls a number of times and the time of actuation of the fuel pump, and sets a pressure of the fuel as a consideration element in actuation of the fuel pump so as to prevent repetitive actuation of the fuel pump, improve the endurance, and increase the life.

In one aspect, a method for controlling fuel pump of vehicle according to the present disclosure to accomplish the object described above includes: sensing a vehicle door lock release signal; detecting a fuel pressure in a fuel line; and actuating the fuel pump so that the fuel pressure reaches a predetermined target pressure when the detected fuel pressure is below a predetermined actuation pressure.

In a preferred embodiment where the fuel pressure reaches the target pressure, the actuation of the fuel pump can be stopped and an actuation completion count can be accumulated.

In another preferred embodiment, the sensing step can further include an actuation restriction step of judging whether the accumulated actuation completion count is below a predetermined actuation restriction number of times, and not performing the actuation of the fuel pump when the accumulated actuation completion count is below the actuation restriction number of times.

In still another preferred embodiment, the accumulated actuation completion count can be reset at the time of a vehicle start.

In yet another preferred embodiment, the detecting step can further detect a fuel temperature, the fuel can be a gas fuel, and the predetermined actuation pressure can be a pressure value at which the fuel can maintain a liquid state at the detected fuel temperature.

In still yet another preferred embodiment, the gas fuel can be an LPG (liquefied petroleum gas) fuel.

In still yet another preferred embodiment, the actuating step can further include an actuation time restriction step of counting the actuation time at the time of actuation of the fuel pump, and stopping the actuation of the fuel pump when the counted actuation time exceeds the predetermined limit time.

It is understood that the term "vehicle" or "vehicular" or other similar term as used herein is inclusive of motor vehicles in general such as passenger automobiles including sports utility vehicles SUV, buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles e.g. fuels derived from resources other than petroleum. As referred to herein, a hybrid vehicle is a vehicle that has two or more sources of power, for example both gasoline-powered and electric-powered vehicles.

BRIEF DESCRIPTION OF THE DRAWINGS

The above and other features of the present disclosure will now be described in detail with reference to certain exemplary embodiments thereof illustrated the accompanying drawings which are given hereinbelow by way of illustration only, and thus are not limitative of the present disclosure, and wherein:

FIG. 1 is a flow diagram of a method for controlling a fuel pump of a vehicle.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment.

In the FIGURES, reference numbers refer to the same or equivalent parts of the present disclosure throughout the several FIGURES of the drawing.

DETAILED DESCRIPTION

Hereinafter reference will now be made in detail to various embodiments of the present disclosure, examples of which are illustrated in the accompanying drawings and described below. While the disclosure will be described in conjunction with exemplary embodiments, it will be understood that present description is not intended to limit the disclosure to those exemplary embodiments. On the contrary, the disclosure is intended to cover not only the exemplary embodiments, but also various alternatives, modifications, equivalents and other embodiments, which may be included within the spirit and scope of the disclosure as defined by the appended claims.

A method for controlling a fuel pump of a vehicle according to an embodiment of the present disclosure will be described below in more detail with reference to the accompanying drawings.

FIG. 1 is a flow diagram of a method for controlling the fuel pump of the vehicle, the method comprising: a sensing step S100 of sensing a vehicle door lock release signal; a detecting step S200 of detecting a fuel pressure in a fuel line; and an actuating step S500 of actuating the fuel pump so that the fuel pressure reaches a predetermined target pressure in case where the detected fuel pressure is below a predetermined actuation pressure.

Specifically, the sensing step S100 may precedently actuate the fuel pump by sensing the door lock release signal before an application of IG-ON of a key type vehicle or a START button of a button start type vehicle. The door lock release signal of the drivers remote control may be input to a battery control module (BCM), the battery control module may transmit the input signal to an LPI engine controller through a can communication or a wire line, and the LPI controller may recognize the relevant signal, enter an actuation ready state, and precedently actuate and control the fuel pump according to the condition of engine.

The door lock release signal of the sensing step S100 may include not only the door lock release signal through the remote control, but also a signal at the time of unlocking the door by inserting a key. The door lock release signal may also sense an open/close signal of the door and include a signal of converting to a state capable of unlocking the lock although the lock release is not obtained. The start signal for precedently actuating the fuel pump may be set variously.

Meanwhile, when the fuel pressure reaches the target pressure, the actuation of the fuel pump is stopped S800 and an actuation completion count can be accumulated. Where the lock release signal is applied in the sensing step S100, the sensing step can further perform an actuation restriction step S300 of judging whether the accumulated actuation completion count is below a predetermined actuation restriction number, and of not performing the actuation of the fuel pump where the accumulated actuation completion count is below the actuation restriction number.

The actuation restriction step S300 may prevent the fuel pump from unnecessarily and excessively being actuated by repetitive lock releases or opening/closing of the door before start of the vehicle, and allow the fuel pump to perform the actuation when counting an actuation number of times during an identical engine stop condition. For example, this may be from the time when the door lock release is actuated to the time before the start is applied or from the time when the start is ended to the time of the next start and the counted number of times is within the predetermined actuation restriction number. Based on this information, the actuation restriction step S300 may allow the fuel pump to restrict the actuation when the counted number of times exceeds the predetermined actuation restriction number of times. Furthermore, the accumulated actuation completion count may be reset when the start is performed on the vehicle.

It is preferable to count the accumulation of the actuation completions after the fuel pressure reaches the target pressure, however the time of count may be set variously. For example, it may be performed after the actuation restriction step S300.

Where the accumulated actuation completion count is below the predetermined actuation restriction number of times in the actuation restriction step S300, it is then judged whether the detected fuel pressure is below the predetermined actuation pressure S400. Where the detected fuel pressure is below the predetermined actuation pressure, the actuation step S500 may be performed.

Specifically, the detecting step S200 may further detect a fuel temperature, and the fuel may be a gas fuel and preferably a liquefied petroleum gas (LPG) fuel, and it is preferable that the predetermined actuation pressure is a pressure value at which the fuel can maintain a liquid state at the detected fuel temperature.

The pressure value at which the LPG fuel may maintain a liquid state according to the fuel temperature can be set in advance according to a saturated steam pressure curve depending on temperature/pressure conditions of the LPG fuel, and may be provided in a map data form to be able to derive the actuation pressure corresponding thereto at the time of detecting the fuel temperature. Where the detected fuel pressure is below the derived actuation pressure, since it is required to raise the pressure in order to maintain the liquid state of the LPG fuel, the fuel pump may be actuated.

In the present embodiment, the actuation pressure is set as the actuation condition of the fuel pump to use the LPG fuel and the LPG fuel is injected in the liquid state. However, the actuation pressure can be variously set according to the type of the fuel. For example, different actuation pressures can be set where the fuel is CNG, gasoline or diesel.

Meanwhile, the actuation step can further perform an actuation time restriction step S600 of counting the actuation time at the time of actuation of the fuel pump, and stopping the actuation of the fuel pump in case where the counted actuation time exceeds the predetermined limit time.

The actuation time restriction step S600 is to prevent the fuel pump from being excessively actuated so as to prevent excessive heating of the fuel pump and to increase the part's life. It is preferred that the actuation time count of the fuel pump is reset if the actuation of the fuel pump is stopped and restarted again at the time of the next actuation of the fuel pump.

After the actuation step S500, it is judged whether the detected fuel pressure arrives at the predetermined target pressure S700. The actuation of the fuel pump can be stopped where the detected fuel pressure arrives at the predetermined target pressure S800, and the actuation completion count can be accumulated.

The target pressure is the pressure at which the fuel in the fuel line can maintain a liquid state, and the target pressure can be set to be same as the actuation pressure or can be set to be greater than the actuation pressure. The target pressure can be variously set according to the intent of the designer and experimental data.

According to the method for controlling a fuel pump of a vehicle composed of a structure described above, the repetitive actuation of the fuel pump can be prevented even at the time of the precedent actuation so as to prevent excessive actuation of the fuel pump and improve part endurance.

In addition, noise due to frequent actuation can be reduced so as to improve a consumer's satisfaction with the product.

According to the method for controlling the fuel pump of the vehicle composed of a structure described above, the repetitive actuation of the fuel pump can be prevented even at the time of the precedent actuation to prevent excessive actuation of the fuel pump and improve part endurance.

In addition, noise due to frequent actuation can be reduced to improve a consumer's satisfaction of the product.

The disclosure has been described in detail with reference to preferred embodiments thereof. However, it will be appreciated by those skilled in the art that changes may be made in these embodiments without departing from the principles and spirit of the disclosure, the scope of which is defined in the appended claims and their equivalents.

What is claimed is:

1. A method for controlling a fuel pump of a vehicle comprising:

sensing a vehicle door lock release signal;

detecting a fuel pressure in a fuel line; and actuating the fuel pump so the fuel pressure arrives at a predetermined target pressure when the detected fuel pressure is below a predetermined actuation pressure, wherein when the fuel pressure arrives at the target pressure, the actuation of the fuel pump is stopped and an actuation completion count is accumulated, and wherein the sensing step further includes an actuation restriction step of judging whether the accumulated actuation completion count is below a predetermined actuation restriction number of times, and not performing the actuation of the fuel pump when the accumulated actuation completion count is below the actuation restriction number of times.

2. The method for controlling the fuel pump of the vehicle of claim 1, wherein the accumulated actuation completion count is reset at the time of a vehicle start.

3. The method for controlling the fuel pump of the vehicle of claim 1, wherein the detecting step further detects a fuel temperature and the fuel is a gas fuel, and the predetermined actuation pressure is a pressure value at which the fuel can maintain a liquid state at the detected fuel temperature.

4. The method for controlling the fuel pump of the vehicle of claim 3, wherein the gas fuel is an LPG (Liquefied Petroleum Gas) fuel.

5. The method for controlling the fuel pump of the vehicle of claim 1, wherein the actuation step further includes an actuation time restriction step of counting the actuation time at the time of actuation of the fuel pump, and stopping the actuation of the fuel pump where the counted actuation time exceeds a predetermined limit.

* * * * *